US005774977A

United States Patent [19]

Folk et al.

[11] Patent Number: 5,774,977

[45] Date of Patent: Jul. 7, 1998

[54] APPLICATOR FOR TERMINATING ELECTRICAL WIRES

[75] Inventors: Kenneth Foster Folk, Harrisburg; William Herbert Bair, Mechanicsburg, both of Pa.

[73] Assignee: The Whitaker Corporation, Wilmington, Del.

[21] Appl. No.: 689,744

[22] Filed: Aug. 13, 1996

[51] Int. Cl.[6] ..... H01R 43/048

[52] U.S. Cl. ..... 29/753; 29/760; 29/863; 72/712

[58] Field of Search ..... 29/33 M, 753, 29/759, 760, 861, 863; 72/441, 712

[56] References Cited

U.S. PATENT DOCUMENTS

| | | | |
|---|---|---|---|
| 4,114,253 | 9/1978 | Loomis et al. | 29/753 X |
| 4,313,258 | 2/1982 | Kindig et al. | 29/753 X |
| 4,707,913 | 11/1987 | Moline | 29/753 |
| 4,979,291 | 12/1990 | Phillips et al. | 29/863 |
| 5,410,803 | 5/1995 | Gerhard, Jr. | 29/753 |
| 5,483,739 | 1/1996 | Smith et al. | 72/441 X |

FOREIGN PATENT DOCUMENTS

| | | | |
|---|---|---|---|
| 139368 | 5/1985 | European Pat. Off. | 29/753 |
| 3540083 | 5/1987 | Germany | 29/753 |
| 92-2059 | 2/1992 | WIPO | 29/753 |

*Primary Examiner*—Peter Vo
*Attorney, Agent, or Firm*—Marshall E. Rosenberg

[57] ABSTRACT

A terminal applicator (10) is provided for attaching terminals to electrical conductors. The applicator (10) includes a frame (12) having a base plate (28) and two upright plates (34,38) extending upwardly from the base plate. The two upright plates (34,38) are rigidly attached to each other along a surface (42,44) adjacent an edge of each so that they form a right angle. One end of each of the upright plates (34,38) is rigidly attached to the base plate (28) at right angles thereto. A ramway (50) is rigidly attached to one of the upright plates (34) and is in sliding engagement with an opening (94) in a ram (14). The ram (14) is arranged for reciprocating motion toward and away from the base plate (28) and includes outer surfaces (112,114,116,118) for mounting crimping tooling and cams (120) or other power takeoff devices.

20 Claims, 4 Drawing Sheets

APPLICATOR FOR TERMINATING ELECTRICAL WIRES

The present invention relates to applicators for attaching terminals to electrical wires and more particularly to an improved frame for such an applicator.

BACKGROUND OF THE INVENTION

Applicators for attaching terminals to electrical conductors are generally received in a larger press or power unit that provides the power and physical motion to actuate the applicator and effect the crimping operation. These applicators include a ram that is guided within an opening in a ram housing and arranged to undergo reciprocating motion along a ram axis. The ram housing is an integral part of a frame and includes a base portion having a crimping anvil attached thereto that mates with upper crimping tooling mounted to the ram. The ram housing and frame are typically cast as a single integral part which is relatively expensive to manufacture. A terminal feed mechanism operated by the reciprocating ram is attached to the frame so that it can engage a strip of terminals being fed from a reel and feed them into the crimping station of the applicator in timed relation to movement of the ram. Examples of such an applicator are disclosed in U.S. Pat. Nos. 3,184,950 which issued May 25, 1965 to Sitz and 5,483,739 which issued Jan. 16, 1996 to Smith et al. Both of these patents disclose applicators wherein the ram housings completely encircle their respective rams when viewed along the ram's axis. That is, each ram housing has a rectangular opening formed by four walls and the ram has four outer walls in sliding engagement with the four walls of the opening. The upper crimping tooling is mounted to one of the outer walls of the ram but necessarily leaving a portion of the outer wall exposed on either side for engagement with the respective wall of the opening. A corresponding groove is formed in the opening wall opposite the tooling to provide clearance. A disadvantage of such a structure is that when it is desired to change the upper crimping tooling, the applicator must be removed from the press and the ram must be removed from the applicator. This translates to production down time as well as a risk that the applicator will not be properly reassembled. Another disadvantage of such a structure is that it is difficult to access the ram for attachment of actuating mechanisms for operating the terminal feed unit or other features such as an insulation stripper. Further, in certain applications it is desirable to feed the strip of terminals in a direction that is perpendicular to the axis of the conductor being terminated. This is called side feed and is incorporated in the applicator of the '739 patent. In other applications the direction of feed must be parallel to the axis of the conductor. This is called end feed and is incorporated in the applicator of the '950 patent. The encircling ram housings of these applicators precludes easily converting between side feed and end feed, therefore, one applicator of each must be maintained. Similarly, it is difficult to switch the feed mechanism of the applicator between prefeed and postfeed because the attachment linkage of the feed mechanism to the ram is not easily accessible.

What is needed is an applicator wherein the ram has several exposed outer surfaces that can be easily accessed for attaching cams or other power takeoff devices for actuating the terminal feed mechanism and other devices. Further, the upper crimping tooling should be easily replaceable and the feed mechanism should be easily switchable between prefeed and postfeed without removing the ram from the applicator. Additionally, the applicator should permit the easy conversion between side feed and end feed.

SUMMARY OF THE INVENTION

An applicator operable for attaching terminals to electrical conductors is provided. The applicator includes a frame, a tool mounting surface attached to the frame adapted to receive lower termination tooling, and a ram coupled to the frame adapted to receive upper tooling for mating with the lower tooling for effecting the attaching of the terminals. The ram is arranged for reciprocating movement along an axis in a first direction toward the mounting surface and in a second opposite direction. A feed mechanism is arranged for feeding the terminals during operation of the applicator. The frame includes a base plate having first and second opposite major surfaces. The first surface is substantially flat and arranged to mount the applicator to another surface. A first upright plate extends from the second surface and has a third major surface perpendicular to the first surface. A second upright plate extends from the second surface adjacent the first upright plate and has a fourth major surface perpendicular to both the first surface and the third surface. The feed mechanism is attached to one of the third and fourth major surfaces.

DESCRIPTION OF THE PREFERRED EMBODIMENT

Figure 2:
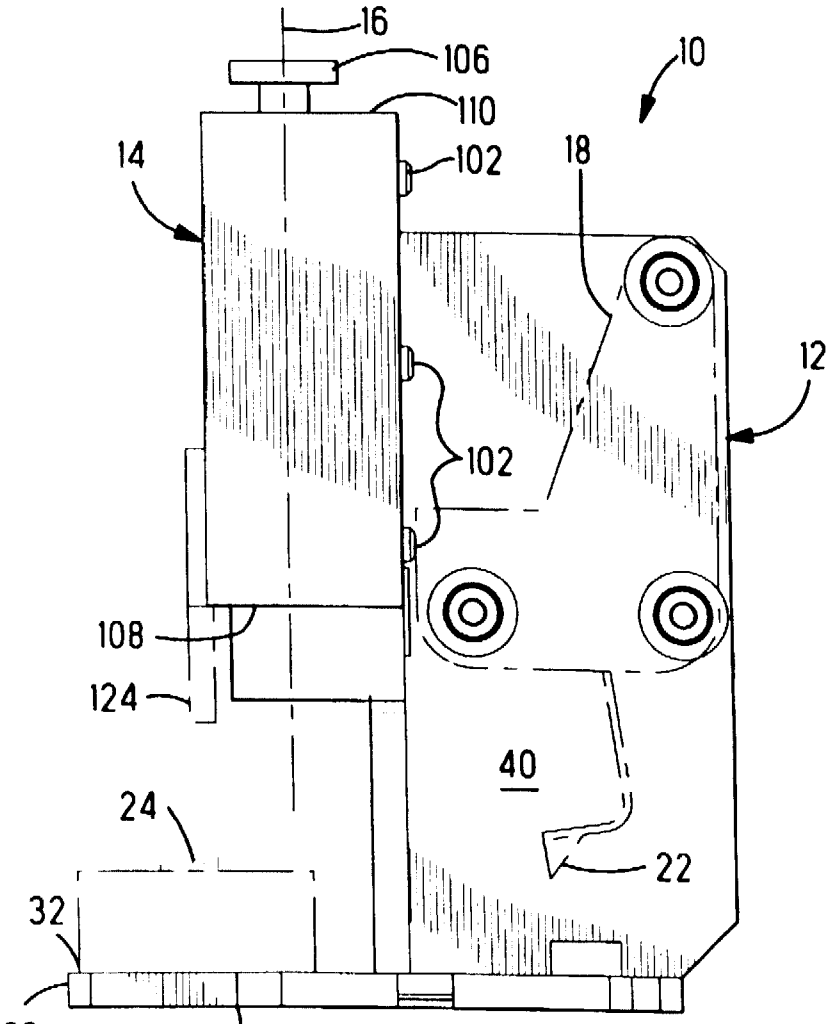
FIG. 2 is a side view of the applicator shown in FIG. 1.
Figure 1:
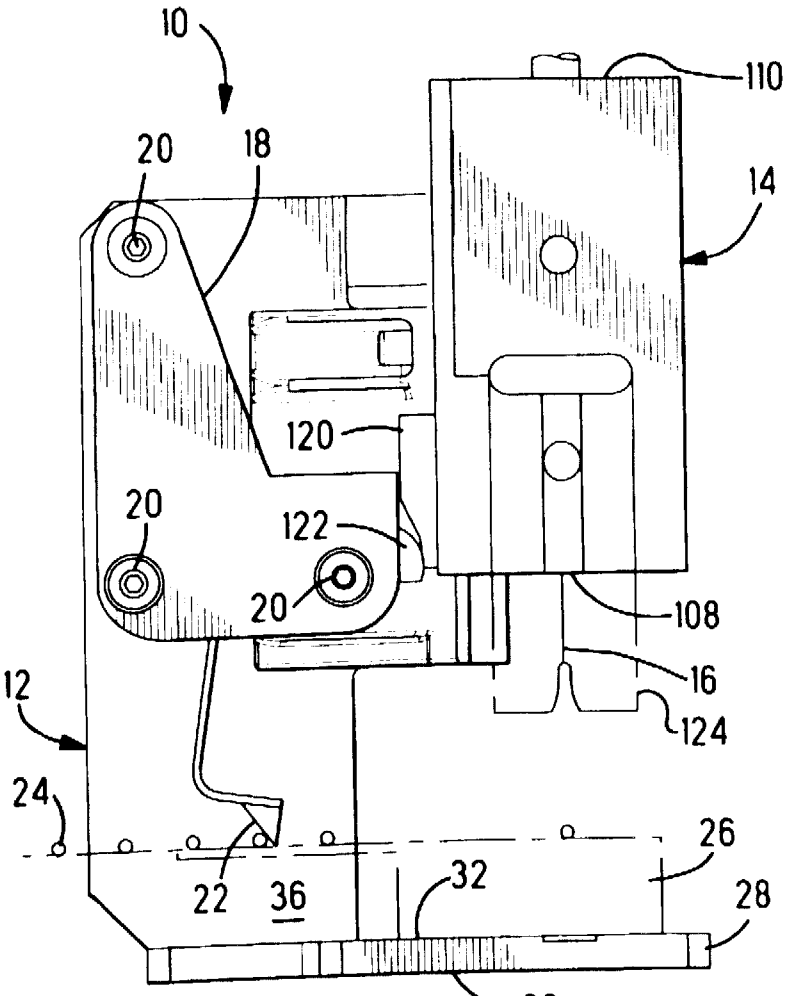
FIG. 1 is a front view of a terminal applicator incorporating the teachings of the present invention.
Figure 3:
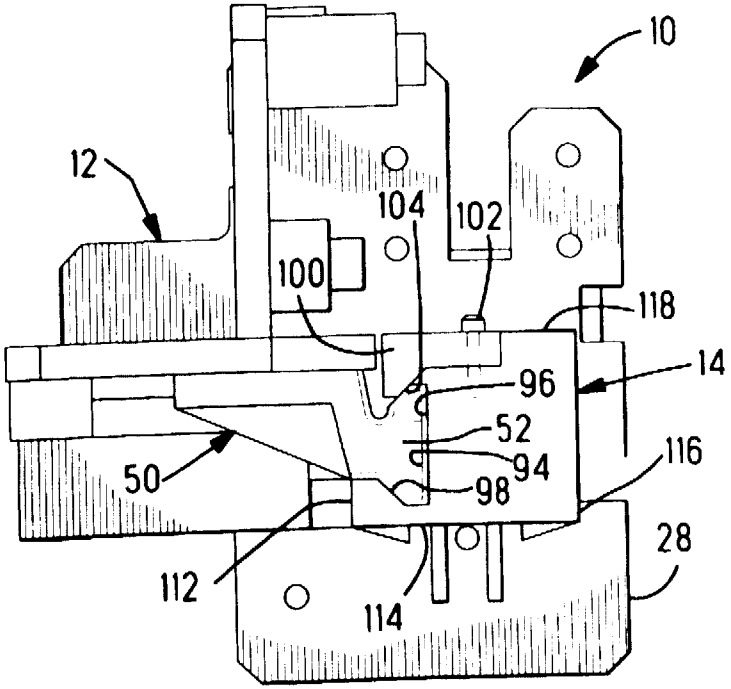
FIG. 3 is a top view of the applicator shown in FIG. 1.

A terminal applicator 10 is shown in FIGS. 1, 2, and 3 including a frame 12, a ram 14 arranged to undergo reciprocating motion with respect to the frame along an axis 16, and a terminal feed mechanism 18 removably attached to the frame 12 by means of screws 20. The terminal feed mechanism 18 includes a feed pawl 22 that is manipulated by the feed mechanism to engage and move a strip of terminals 24 in timed relation with the motion of the ram in the usual manner As shown in FIGS. 4 through 7, the frame 12 includes a base plate 28 having a lower flat mounting surface 30 and an upper surface 32 to which lower crimping or termination tooling 26, shown in FIG. 1, such as a crimping anvil may be attached. The lower flat mounting surface 30 is arranged to engage a press platen when securing the applicator in a press or power unit. A first upright plate 34 having a first major surface 36 and a second upright plate 38 having a second major surface 40 are attached to the base plate 28 and extend upwardly and away from the surface 32, as viewed in FIGS. 5 and 6, so that the first and second major surfaces 36 and 40 are perpendicular to the mounting surface 30. The two upright plates are attached along adjacent surfaces 42 and 44 so that the major surfaces 36 and 40 are at a right angle to each other, as best seen in FIG. 7. The attachment of the upright plates 34 and 38 and the base plate 28 to each other may be effected by any suitable means that will form a strong integral frame structure such as welding, as shown at 46 in FIG. 4.

Figure 4:
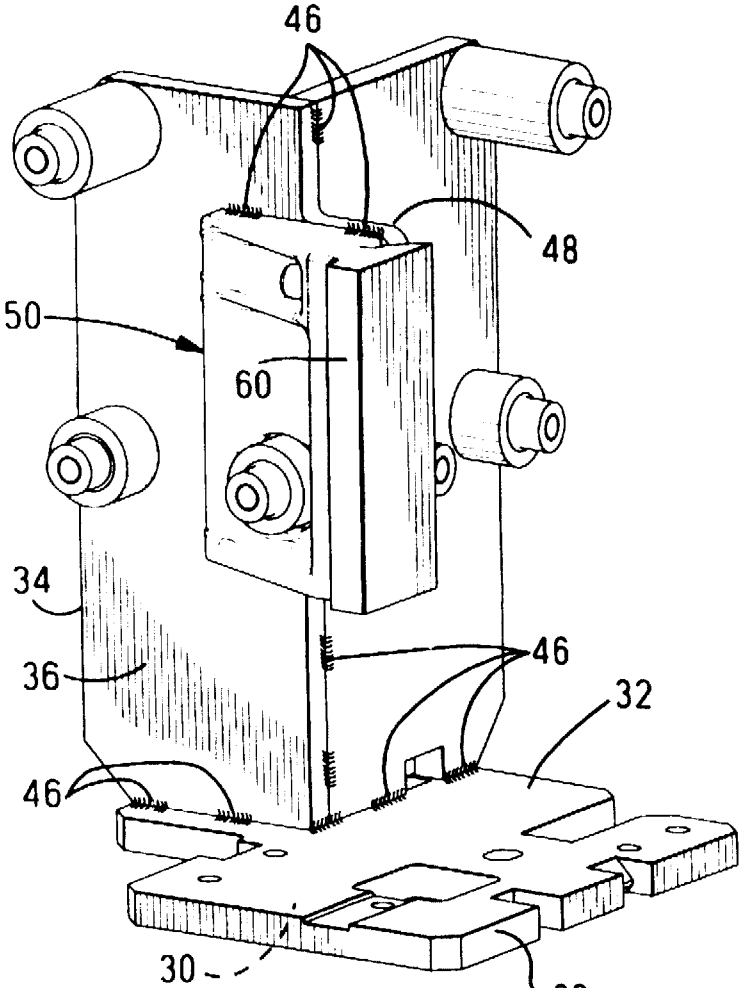
FIG. 4 is an isometric view of the frame of the applicator shown in FIG. 1.
Figure 6:
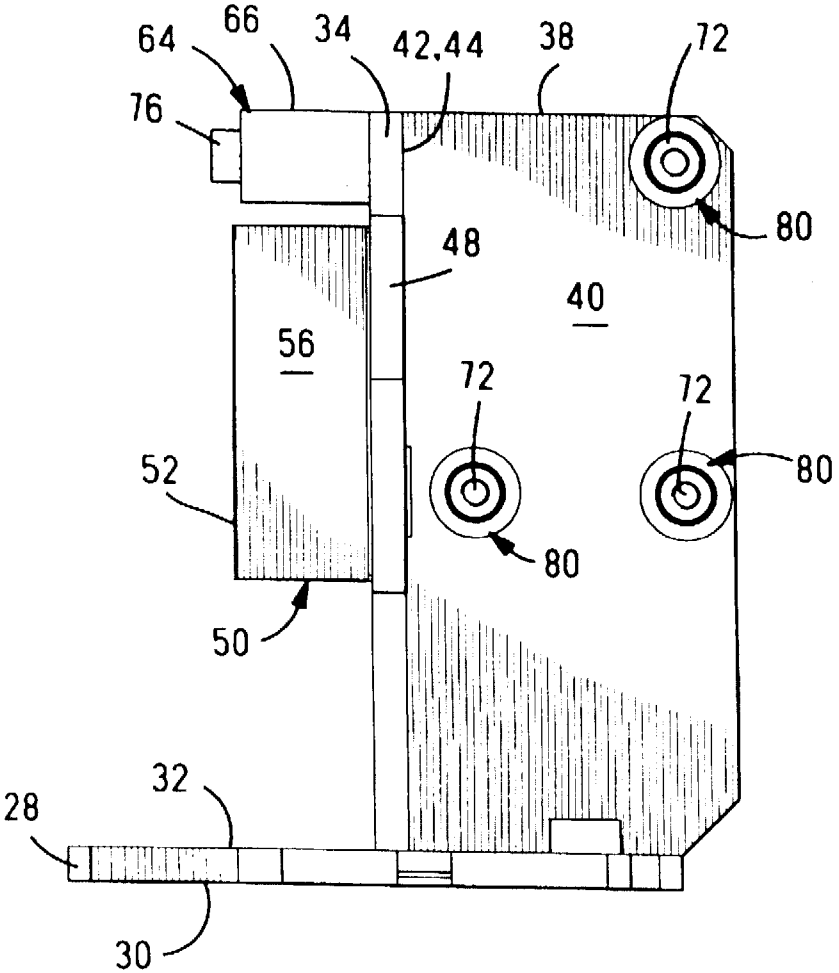
FIG. 6 is a side view of the frame shown in FIG. 4.
Figure 5:
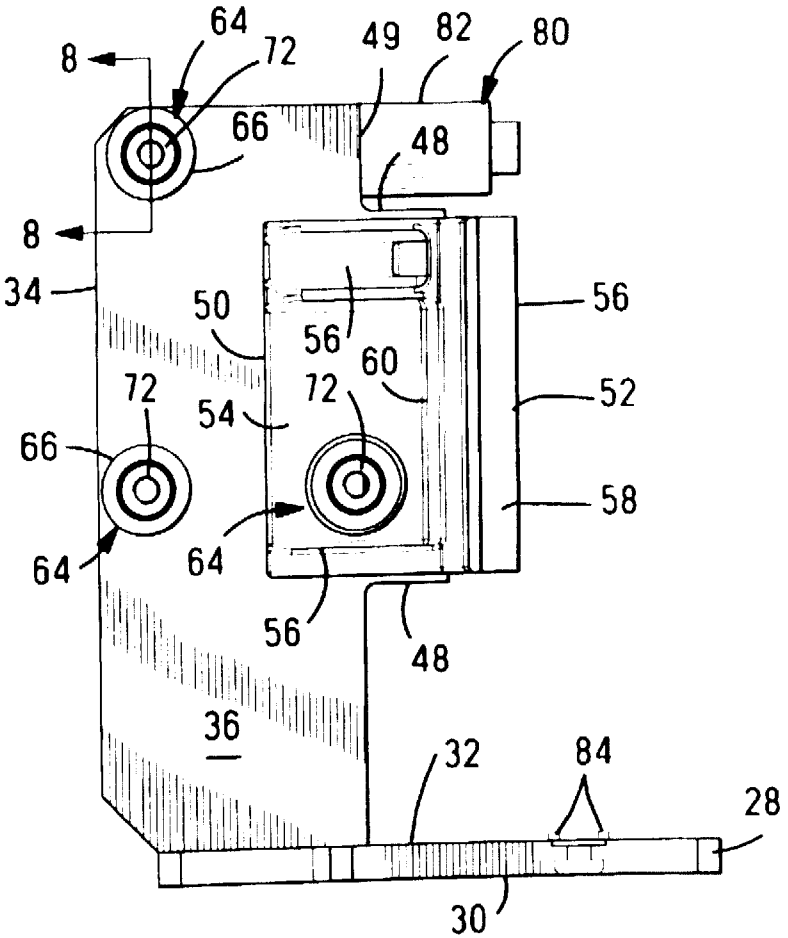
FIG. 5 is a front view of the frame shown in FIG. 4.
Figure 7:
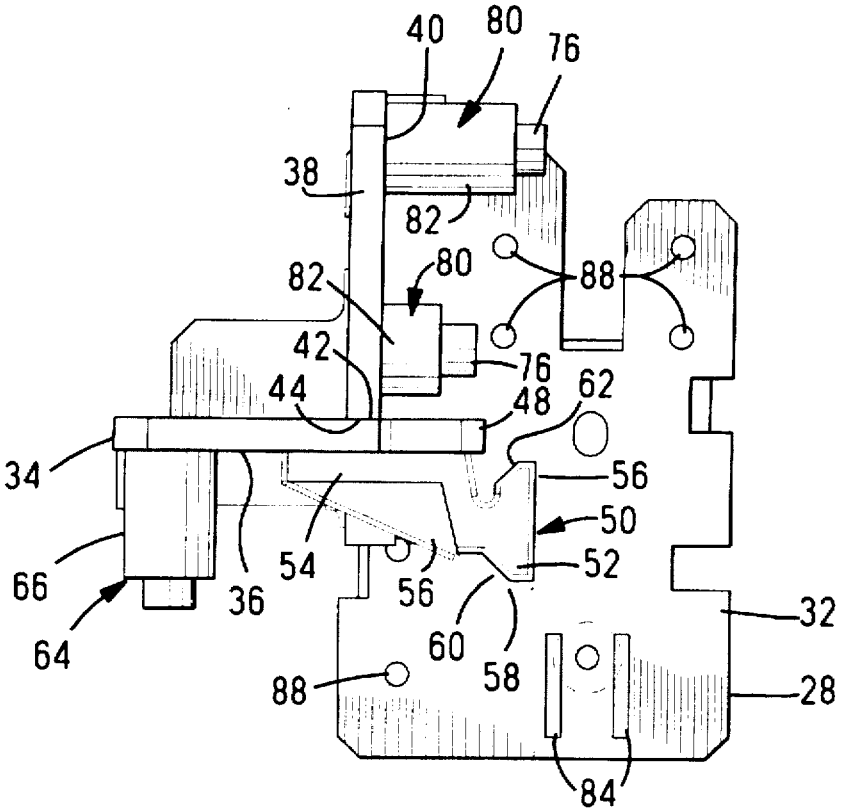
FIG. 7 is a top view of the frame shown in FIG. 4.
Figure 8:
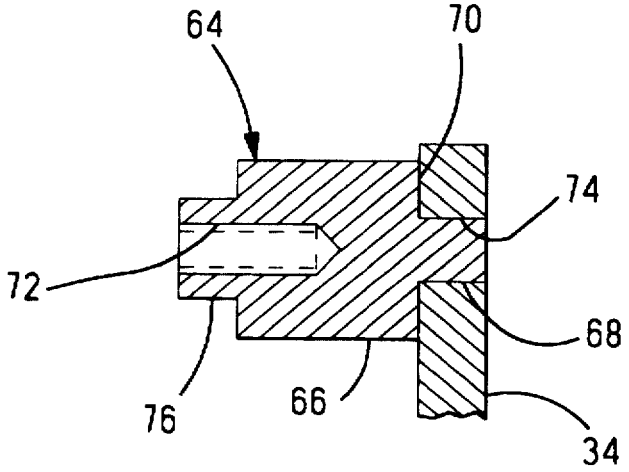
FIG. 8 is a cross-sectional view taken along the lines 8—8 in FIG. 5.

The first upright plate 34, as best seen in FIGS. 4, 5, and 6, includes a rectangular flange 48 extending outwardly from an end 49 adjacent the surface 42 for supporting a ramway 50. The ramway 50, which is cast as an integral unit, includes a first slide portion in the form of a T-shaped member 52 and a mounting flange 54 that is rigidly attached to the first upright plate 34, by means of welding for example as shown at 46 in FIG. 4. Two support gussets 56 extend between the mounting flange 54 and the T-shaped member 52 for added rigidity. The T-shaped member includes a slide surface 56 and two opposite beveled surfaces 60 and 62 for sliding engagement with the ram 14, as will be explained below. The surfaces 56, 60, and 62 are perpendicular to the mounting surface 30. While the mounting surface 30 and the surface 32 need not be parallel, they are so in the present example. Three cylindrically shaped standoffs 64 are attached to the first upright plate 34 in the position shown in FIGS. 5 and 7 for mounting the feed unit 18 to the first major surface 36. Each standoff 64, as shown in FIG. 8, includes a body 66, a reduced diameter 68 that forms a shoulder 70, and a threaded hole 72 formed in the end of the body opposite the shoulder. The reduced diameter 68 of each standoff is either a tight press fit within a hole 74 formed through the upright plate 34 or it is a light fit within the hole and welded in place to form a rigid structure. The end having the threaded hole 72 may optionally be a reduced diameter 76 to provide pivot diameters for the terminal feed mechanism, if required. Similarly, three cylindrically shaped standoffs 80 are attached to the second upright plate 38 in the position shown in FIGS. 6 and 7 for mounting the feed unit 18 to the second major surface 40. Each standoff 80 includes a body 82 that is longer than the body 66, but is otherwise similar in all respects to the standoff 64 and is attached to the second upright plate 38 in the same way. The terminal feed unit 18, which may be any suitable feed unit known in the industry, is mounted to the surface 36, as shown in FIG. 1, for side feed applications or is mounted to the surface 40, as shown in phantom lines in FIG. 2, for end feed applications, as desired. Optionally, the standoffs 80 may be omitted entirely from the frame 12 for side feed applications and similarly the standoffs 64 may be omitted entirely from the frame 12 for end feed applications.

The upper surface 32 of the base plate 28 includes features, such as raised portions 84 suitable for accurately positioning crimping tooling 26 with respect to the ram 14. Threaded holes 88 are formed in the base plate for receiving mounting screws for securing terminal positioning tooling to the surface 32. These positioning features and threaded holes are, of course, dependent upon and must conform to the structure of the crimping tooling to be mounted on the surface 32.

As shown in FIGS. 1, 2, and 3, the ram 14 includes a second slide portion in the form of an opening 94 having surfaces 96 and 98 in sliding engagement with the surfaces 56 and 60 of the T-shaped member 52. A gib 100 is secured to the side of the ram 14 by means of screws 102, as best seen in FIG. 3. The gib 100 includes a slide surface 104 in sliding engagement with the beveled surface 62 so that the T-shaped member 52 is maintained in sliding engagement with the opening 94. The gib 100 is laterally adjustable by means of shims or set screws, not shown, to remove or minimize any lateral play between the ram and the ramway 50. A T-shaped coupling 106 is attached to the upper end 110 of the ram 14 for coupling to the ram of a press or power unit, not shown, while the opposite end 108 of the ram faces the surface 32. The press or power unit provides the necessary motion and power to operate the applicator, in the usual manner. The ramway 50 and opening 94 cooperate to guide the ram 14 during its reciprocating motion toward and away from the surface 32 along the axis 16 which, as stated above, is perpendicular to the mounting surface 30. Because the T-shaped portion 52 of the ramway 50 is disposed within the opening 94 of the ram 14, the outer surfaces 112, 114, 116, and 118 of the ram are completely open and accessible. This allows for the easy mounting of upper crimping or termination tooling 124 that mates with the lower tooling 26, and the mounting of actuating members such as the cam 120, shown in FIG. 1. These outer surfaces 112, 114, 116, and 118 are all perpendicular to the mounting surface 30 and parallel to the axis 16. The cross section of the ram 14, as viewed in the direction of the axis 16, is of rectangular shape wherein each outer surface 112, 114, 116, and 118 forms right angles with adjacent outer surfaces. In the present example, an actuating cam 120 is attached to the surface 112 of the ram and arranged to engage a follower 122 that is part of the terminal feed unit 18. When the ram 14 moves along the axis 16 the cam 120 moves the follower 122 which actuates the feed mechanism thereby causing the feed pawl to advance a strip of terminals in the usual manner. The position of the cam on the ram surface 112 is adjustable so that the timing of the feed can be coordinated with the crimping cycle. Typically, the terminal crimping bar and the insulation crimping bar, not shown, are mounted to the ram surface 114. In special applications, the outer surfaces 116 and 118 are also available for receiving and mounting the crimping bars. The outer surfaces 112, 114, 116, and 118 are completely open and unobstructed by the ramway 50 and the walls of the opening 94, therefore, there is easy access to the crimping tooling and the feed actuating cam 120, or other actuating devices that may be attached to these surfaces.

While, in the present example, the outer surfaces 112, 114, 116, and 118 of the ram 14 form a rectangular cross section, the teachings of the present invention may be practiced by using outer surfaces that form different cross-sectional shapes. Further, the first slide portion or T-shaped member 52 having the surface 56 and two beveled surfaces 60 and 62 and the second slide portion or opening 94 of the ram 14 that slidingly mates with these surfaces, are by way of example. Other similar structures for the first and second slide portions that leave the outer surfaces of the ram 14 open and unobstructed are deemed within the teachings of the present invention.

An important advantage of the present invention is that the ram has several exposed outer surfaces that can be easily accessed for attaching cams or other power takeoff devices for actuating other mechanisms that may be desirable such as an insulation stripper. This permits easy access for adjusting the stroke of the feed mechanism. Further, the upper crimping tooling and the feed unit actuating cam 120 can be easily adjusted or completely replaced, as desired, without removing the ram 14 from the frame 12 and without removing the applicator from the press. Additionally, the applicator permits easy conversion between side feed and end feed and between prefeed and postfeed without the need to remove the applicator from the press. Further, the welded plate structure of the frame 12 is easily and economically manufactured and avoids the relatively high cost of a cast frame.

We claim:

1. An applicator operable for attaching terminals to electrical conductors, said applicator having a frame, a tool mounting surface attached to said frame and adapted to receive lower termination tooling, a ram coupled to said frame and arranged for reciprocating movement along an axis in a first direction toward said mounting surface and in a second opposite direction, said ram adapted to receive upper terminating tooling for mating with said lower terminating tooling for effecting said attaching of said terminals, and a feed mechanism arranged for feeding said terminals during operation of said applicator, said frame comprising:

(1) a base plate having first and second opposite major surfaces, said first surface being substantially flat and arranged to mount said applicator to another surface;

(2) a first upright plate extending from said second surface, and having a third major surface perpendicular to said first surface; and (3) a second upright plate extending from said second surface adjacent said first upright plate, and having a fourth major surface perpendicular to both said first surface and said third surface;

wherein said first and second upright plates are mutually attached adjacent an outer edge of each said plate, and wherein said ram is spaced from both said first and second upright plates and said feed mechanism is attached to one of said third and fourth major surfaces.

2. The applicator according to claim 1 including a first slide portion attached to one of said first and second upright plates and a second slide portion associated with said ram, wherein said first and second slide portions are mated in sliding engagement for guiding said ram along said axis during said reciprocating motion.

3. The applicator according to claim 2 wherein said second slide portion is an opening in said ram.

4. The applicator according to claim 3 wherein said ram includes an outer surface that is parallel to said axis and is open and unobstructed by both said first and second slide portions.

5. The applicator according to claim 4 wherein said first slide portion is a T-shaped member in said sliding engagement with said opening, said T-shaped member having a beveled surface along an edge thereof and said opening including a movable gib in engagement with said beveled surface for limiting play between said ram and said T-shaped member.

6. The applicator according to claim 1 wherein said feed mechanism is attachable to said third surface for effecting side feeding of said terminals and is attachable to said fourth surface for effecting end feeding of said terminals.

7. The applicator according to claim 6 wherein said feed mechanism is coupled to said ram so that said movement of said ram in one of said first and second directions effects operation of said feed mechanism for feeding said terminals.

8. The applicator according to claim 1 wherein said tool mounting surface is a portion of said second surface.

9. An applicator operable for attaching terminals to electrical conductors, said applicator having a frame, a tool mounting surface attached to said frame and adapted to receive lower termination tooling, a ram slidingly coupled to said frame by means of first and second mating slide portions and arranged for reciprocating movement along an axis in a first direction toward said mounting surface and in a second opposite direction, and a feed mechanism arranged for feeding said terminals during said operation of said applicator, said ram having first and second opposite ends and at least one outer surface extending between said first and second ends, said axis being parallel to said at least one outer surface and intersecting said first and second ends, said at least one outer surface adjacent said first end of said ram adapted to receive upper tooling for mating with said lower tooling for effecting said attaching of said terminals to electrical conductors, said first slide portion being attached to said frame and said second slide portion being associated with said ram so that said at least one outer surface is open and unobstructed by either of said first and second slide portions.

10. The applicator according to claim 9 wherein said at least one outer surface comprises four outer surfaces, all of which are open and unobstructed by both said first and second slide portions.

11. The applicator according to claim 10 wherein each of said four outer surfaces is arranged to form a right angle with each adjacent outer surface.

12. The applicator according to claim 9 wherein said frame includes: a base plate having first and second opposite major surfaces, said first surface being substantially flat and arranged to mount said applicator to another surface; a first upright plate extending from said second surface, and having a third major surface perpendicular to said first surface; and a second upright plate extending from said second surface adjacent said first upright plate, and having a fourth major surface perpendicular to both said first surface and said third surface, wherein said feed mechanism is attached to one of said third and fourth major surfaces.

13. The applicator according to claim 12 wherein said first and second upright plates are mutually attached along a surface adjacent an outer edge of each.

14. The applicator according to claim 12 wherein said first slide portion is attached to one of said first and second upright plates.

15. The applicator according to claim 14 wherein said second slide portion is an opening in said ram.

16. The applicator according to claim 15 wherein said first slide portion is a T-shaped member in said sliding engagement with said opening, said T-shaped member having a beveled surface along an edge thereof and said opening including a movable gib in engagement with said beveled surface for limiting play between said ram and said T-shaped member.

17. The applicator according to claim 12 wherein said feed mechanism is attachable to said third surface for effecting side feeding of said terminals and is attachable to said fourth surface for effecting end feeding of said terminals.

18. The applicator according to claim 17 wherein said feed mechanism is coupled to said ram so that said movement of said ram in one of said first and second directions effects operation of said feed mechanism for feeding said terminals.

19. An applicator operable for attaching terminals to electrical conductors, said applicator having a frame, a tool mounting surface attached to said frame and adapted to receive lower termination tooling, a ram coupled to said frame and arranged for reciprocating movement along an axis in a first direction toward said mounting surface and in a second opposite direction, said ram adapted to receive upper terminating tooling for mating with said lower terminating tooling for effecting said attaching of said terminals, and a feed mechanism arranged for feeding said terminals during operation of said applicator, said frame comprising:

(1) a base plate having first and second opposite major surfaces, said first surface being substantially flat and arranged to mount said applicator to another surface;

(2) a first upright plate extending from said second surface, and having a third major surface perpendicular to said first surface;

(3) a second upright plate extending from said second surface adjacent said first upright plate, and having a fourth major surface perpendicular to both said first surface and said third surface; and (4) a first slide portion attached to one of said first and second upright plates in mated sliding engagement with an opening in said ram for guiding said ram along said axis during said reciprocating motion, wherein said ram includes an outer surface that is parallel to said axis and is open and unobstructed by both said first and second slide portions and is spaced from said first and second upright plates.

20. The applicator according to claim 19 wherein said first slide portion is a T-shaped member in said sliding engagement with said opening, said T-shaped member having a beveled surface along an edge thereof and said opening including a movable gib in engagement with said beveled surface for limiting play between said ram and said T-shaped member.

* * * * *